United States Patent [19]

Donovan

[11] 4,288,944

[45] Sep. 15, 1981

[54] SECURITY DOOR

[76] Inventor: Terrence P. Donovan, 7834 Providence Cir., Indianapolis, Ind. 46250

[21] Appl. No.: 44,862

[22] Filed: Jun. 4, 1979

[51] Int. Cl.[3] ..... E05C 9/00

[52] U.S. Cl. ..... 49/395; 49/503; 49/460; 70/276; 292/DIG. 17; 292/39; 292/40

[58] Field of Search ..... 49/395, 394, 503, 504, 49/460; 70/276; 292/40, 39, DIG. 17, 33, 35, 137, 139, 142

[56] References Cited

U.S. PATENT DOCUMENTS

| | | | |
|---|---|---|---|
| 630,762 | 8/1899 | Wilson | 292/142 |
| 1,126,639 | 1/1915 | Janes | 292/35 |
| 1,630,153 | 5/1927 | Williams | 292/40 |
| 1,909,697 | 5/1933 | MacBeth et al. | 49/395 X |
| 2,066,705 | 1/1937 | Vazquer | 292/39 X |
| 2,436,809 | 3/1948 | Joel, Jr. | 70/278 |
| 2,532,630 | 12/1950 | Lickteig | 292/142 |
| 2,732,703 | 1/1956 | Noregaard | 70/276 X |
| 2,972,879 | 2/1961 | Fry | 70/276 |
| 3,654,731 | 4/1972 | Jellinek | 49/504 |
| 3,791,180 | 2/1974 | Doyle | 292/39 X |
| 3,919,869 | 11/1975 | Fromm | 70/276 X |
| 4,088,353 | 5/1978 | Meyer | 292/78 X |
| 4,184,349 | 1/1980 | Zaks | 70/276 X |

*Primary Examiner*—Philip C. Kannan

*Attorney, Agent, or Firm*—Jenkins, Coffey, Hyland, Badger & Conard

[57] ABSTRACT

A security door system includes an actuator mechanism housed in a box-like, closed housing to minimize the possibility of tampering with the actuator mechanism such as would permit unlawful entry through the door. The actuator mechanism drives one or more, and illustratively two, bolts which extend horizontally across the door. One of the bolts enters a receiver in the jamb along the edge of the door opposite the hinged edge. The other bolt enters a receiver provided in the jamb along the hinged door edge. The security door system further includes a jamb and frame construction in which the jamb and surrounding frame cooperate to provide the bolt receivers. A metal reinforcing plate which is fixed to the frame by long wood screws, or the like, forms a wall of the receiver. This metal walled, deep receiver is less susceptible to damage by tampering, such as by springing the jamb or ramming against the door, than prior art security door systems.

17 Claims, 9 Drawing Figures

← 9

SECURITY DOOR

This invention relates to door locking mechanisms, and particularly to a security door system of the single- or multiple-bolt type, and to an improved and strengthened jamb bolt receiver system.

Various types of single- and multiple-bolt lock mechanisms for doors, windows, and the like are known. There are, for example, the systems of the following U.S. Pat. Nos. 2,486,460; 3,792,885; 2,787,154; 1,376,233; 2,066,705; 343,794; 228,241; 2,125,227; 660,403; 2,918,883; 3,110,512; 1,892,512; 1,195,594; 1,216,697; 1,338,689; 419,903; 702,198; 1,288,455; 995,712; 1,513,797; 2,743,126; 2,672,745; 2,946,214; 3,086,383; 3,119,474; 2,847,725; 3,308,579; and 373,338.

It is an object of the present invention to provide an improved and simplified security door system for dwellings, businesses and the like.

According to the invention, the security door system includes a door having an interior side and an exterior side and a perimetrally extending door edge. The door includes means defining a cavity opening into the interior side, a bolt actuator mechanism and a bolt actuator mechanism housing. The housing is located in the cavity so as not to be accessible from the door exterior side. The bolt actuator mechanism includes an actuator spindle. The door includes a first passageway provided between the cavity and the door exterior side, with the actuator spindle extending through the first passageway. The door further includes a second passageway provided between the cavity and the door edge for reciprocably housing a bolt. Means are provided for connecting the interior end of the bolt to the bolt actuator mechanism. A receiver is provided on the door jamb for receiving the bolt exterior end. Exterior and interior handles on the actuator spindle permit movement of the bolt from the exterior and interior sides of the door. A lock mechanism controls movement of the actuator mechanism. The bolt actuator mechanism housing includes passageways aligning with the first and second passageways in the door. The actuator mechanism housing is box-like and is enclosed sufficiently to minimize the likelihood of tampering with the actuator mechanism.

According to an illustrative embodiment, the bolt actuator mechanism includes an arm mounted for movement about the spindle axis as the spindle is turned. The arm includes a distal end providing a lost motion connection between the arm and the bolt. The illustrative lost motion connector includes a slot in the distal end of the arm which extends generally longitudinally of the arm, and a pin on the bolt for engagement in the slot. Rotary movement of the spindle and arm causes reciprocating movement of the bolt.

Illustratively spring means are provided for returning the bolt to a rest position projecting from the door edge. The spring means may include a tension spring attached to the arm and the actuator mechanism housing to return the arm to a rest position in the housing, thereby returning the bolt to its rest position. Alternatively, the spring means may include a tension or compression spring housed in the door adjacent the second passageway, with the bolt including a stop against which the spring means bears. Retraction of the bolt from the rest position will cause the spring means to exert a restoring force on the bolt to return it to the rest position.

According to another embodiment of the invention, the actuator mechanism comprises means providing a rack and means for connecting the rack to the bolt. The actuator mechanism further includes a pinion for engaging the rack, and means for coupling the pinion to be rotated by rotation of the actuator spindle. Rotation of the spindle in one direction withdraws the bolt from its rest position in which it projects from the door edge.

Further according to an illustrative embodiment of the invention, the lock mechanism includes a bolt for projection into interfering relation with the actuator mechanism to prevent rotation of the actuator spindle and retraction of the bolt from the receiver. Illustratively, the second bolt projects into interfering relation with the distal end of the arm to prevent movement of the arm about the spindle axis. Further according to this illustrative embodiment, means are provided for coupling the last-mentioned bolt to a plunger associated with a solenoid. The solenoid is coupled in a circuit which is capable of being completed by means of a card provided with code-spaced conductive strips. The card is inserted into the lock mechanism to complete the circuit through the solenoid, which moves the plunger to move the last-mentioned bolt out of interfering relationship with the bolt actuator mechanism.

Further according to an illustrative embodiment of the invention, a security door system includes a door having a perimetral edge from which a bolt selectively projects to hold the door closed, an interior side and an exterior side. The system includes a door jamb surrounding the door, and a frame surrounding and supporting the jamb. Wall surfaces surround the jamb on both the door interior and exterior sides. A hinge supports the door for movement in one direction to an open orientation and in the other direction to a closed orientation, and a trim casing surrounds the jamb and covers the joint between the jamb and wall. Means are provided to define a receiver portion in the frame aligned with a receiver portion in the jamb. The receiver defining means in the frame includes a metal plate fastened to the frame to provide a wall of the receiver. The metal plate is covered by the wall means and trim casing to minimize tampering with the bolt. The receiver extending through the jamb and into the frame permits an extremely long projection of the bolt into the receiver to minimize the likelihood of unauthorized entry through the door, such as might be achieved in the prior art by jacking or springing the jamb.

The invention may best be understood by referring to the following description and accompanying drawings which illustrate the invention. In the drawings.

Figure 1:
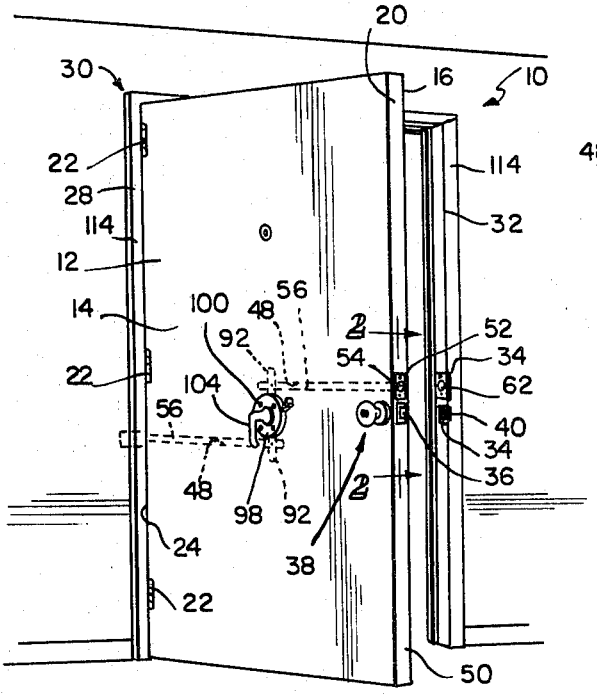
FIG. 1 is an elevational view of a door incorporating a structure in accordance with the invention.
Figure 2:
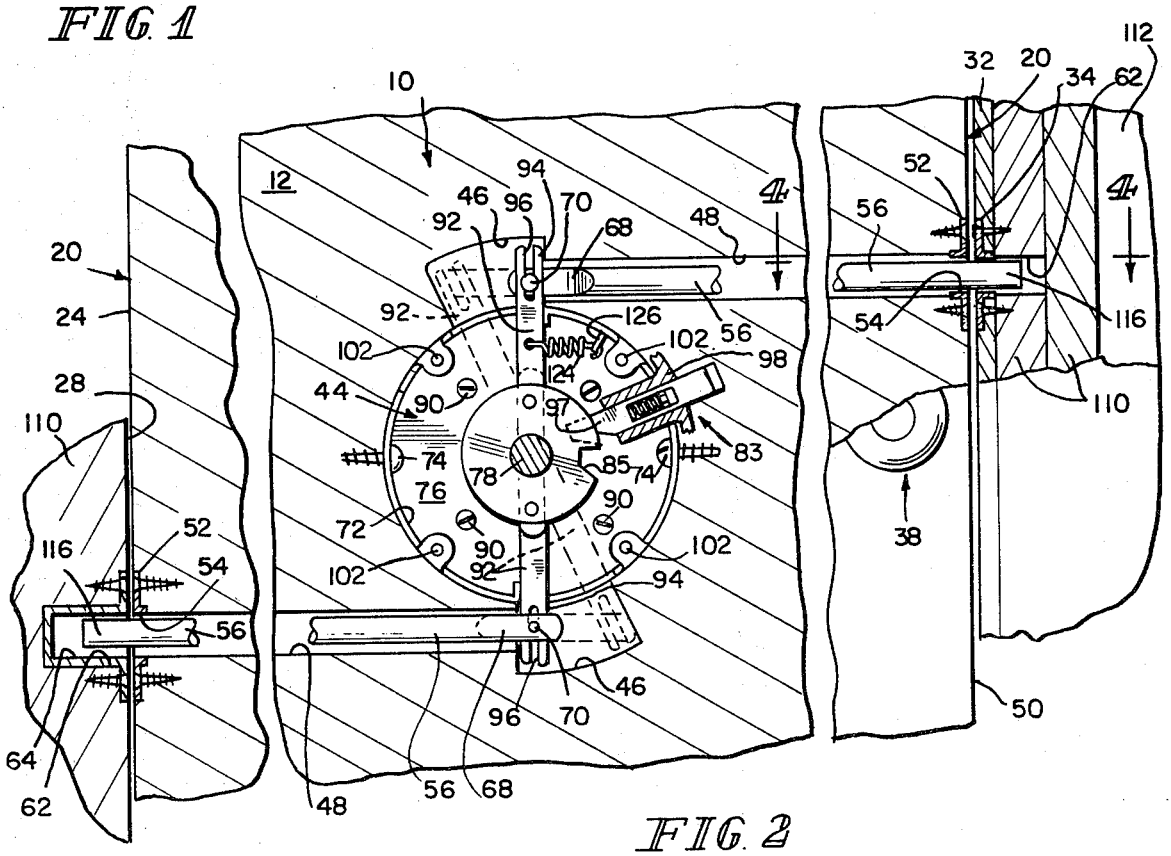
FIG. 2 is a sectional view of the door taken generally along section lines 2—2 of FIG. 1.

Referring now to FIGS. 1–2, a security door system 10 includes a door 12 having an interior side 14, an exterior side 16, and a perimetrally extending door edge 20. The door is supported by hinges 22 along one vertically extending side 24 of edge 20 from a vertically extending portion 28 of a door jamb 30. An opposite vertically extending portion 32 of the jamb 30 is provided with a receiver 34 to receive the bolt 36 associated with a conventional doorknob assembly 38. The receiver 34 is surrounded by a trim strike plate 40. Strike plate 40 is constructed from metal and deflects the bolt 36 inwardly into the door edge 20 to permit the door to close. The bolt 36 conventionally is spring-loaded to project outward to its rest position within the receiver 34, holding the door in the closed position.

The security system further includes a central cavity 44 (FIG. 2) defined within the door 12. The cavity 44 is illustratively right circular cylindrical in shape and opens on the interior side 14 only of the door 12. The cavity 44 is thus "blind" from the exterior side 16 of door 12. As best illustrated in FIG. 2, the cavity 44 includes two somewhat pie-shaped sectors 46 which are provided in the interior of the door 12 and do not open either into the interior side 14 or the exterior side 16 of the door. Bolt passageways 48 extend horizontally across the door interior between the sectors 46 and side 24 of the door edge 20 and the door edge vertically extending side 50 opposite side 24, so that the inner ends of passageways 48 intersect respective sectors 46. A trim plate 52 having a central opening 54 is provided around the outer end of each passageway 48. Bolts 56 are housed reciprocably within the passageways 48.

The jamb 30 vertically extending portions 28, 32 are both provided with additional receivers 62 for the distal ends of the bolts 56. These additional receivers 62 may be provided with trim plates, such as strike plate 34, or with cup-like combination strike plate-receiver liners 64 (FIG. 2).

The inner ends 68 of the bolts 56 extend into the sectors 46 and are provided with engaging pins 70. A cylindrical sheet metal actuator mechanism housing 72 having the same general configuration as central cavity 44 is positioned in the cavity, e.g., by screws 74. Housing 72 has a back wall 76 facing the exterior side 16 of door 12 to minimize the possibility of tampering with the actuator mechanism located in the housing 72. Housing 72 rotatably supports an actuator spindle 78. To maintain the "blind" appearance from the exterior side 16, spindle 78 does not extend through to exterior side 16. No outside knob is provided to operate the actuator mechanism. A spring-loaded lock mechanism 83 mounted on housing 72 is provided on the door interior side 14 for engagement in a detent 85 in the actuator mechanism. A pair of arms 92 project diametrically from the actuator spindle 78. Arms 92 are mounted on the spindle 78 for rotation with the spindle, as illustrated in broken lines in FIG. 2. The ends 94 of arms 92 are provided with slots 96 which extend longitudinally of the arms 92. The slots 96 engage the pins 70 on the inner ends 68 of bolts 56 to provide lost motion connections between the bolts and the ends 94 of the arms 92. Rotation of the actuator mechanism to move arms 92 to their positions illustrated in broken lines in FIG. 2, and projection of the end 97 of lock mechanism 83 into detent 85, holds bolts 56 in their retracted positions.

A trim plate 98 is mounted on the interior side 14 of the door 12 by screws 100 (FIG. 1) which engage in passageways 102 (FIG. 2) provided on the housing 72. A handle 104 is mounted on the actuator spindle 78 on the interior side 14 of the door to permit actuation of the spindle 78 to withdraw the bolts 56 from their respective receivers 62 and permit the door 12 to be opened when the latch bolt 36 is retracted by turning the doorknob assembly 38.

Figure 3:
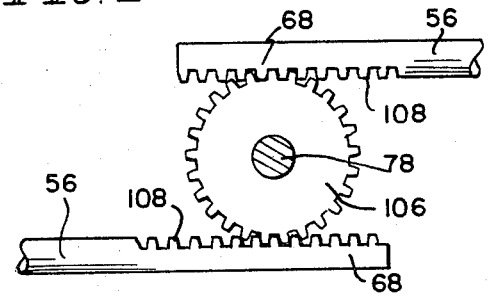
FIG. 3 is a fragmentary elevational view showing an alternative detail to the structure illustrated in FIG. 2.

Turning now to FIG. 3, an alternative actuator mechanism is illustrated diagrammatically. In this actuator mechanism, the spindle 78 supports a pinion gear 106. The inner ends 68 of bolts 56 are formed to provide rack teeth 108 on their sides adjacent to gear 106, with the teeth 108 engaging the gear 106. Rotation of the actuator spindles 78 in one direction (counter-clockwise in FIG. 3) withdraws the outer ends of the bolts 56 from their respective receivers 62.

Figure 4:
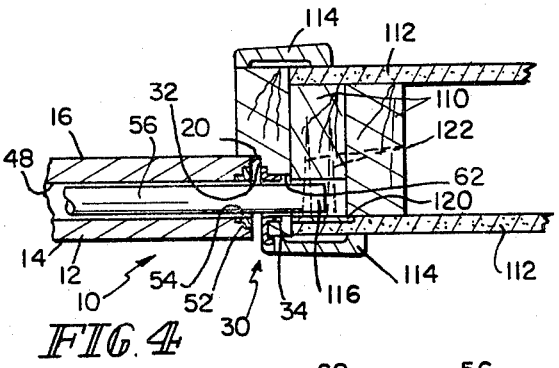
FIG. 4 is a fragmentary sectional view taken generally along section lines 4—4 of FIG. 2.

Turning now to FIG. 4, construction details of a receiver 62 will be explained. The jamb 30 in a typical construction is supported by wall studs 110 along its vertically extending portions and headers (not shown) along its horizontally extending top portion. Illustratively, a plurality of such studs 110 are used to provide a strong construction adjacent the door opening. A covering material 112, such as wall board, is attached to the studs 110, and trim casings 114 surround the door opening on both the interior and exterior sides of the wall. In conventional construction, the receivers for dead bolts, latch bolts and the like extend only into the jamb 30, since prior art bolts for residential dwelling doors are not sufficiently long to penetrate into the surrounding door frame members.

To take advantage of the inherent added strength readily available by virtue of the method of construction of a door opening, the bolts 56 are constructed with outer ends 116 which project outwardly from the door edge 20 hinge side 24 and opposite side 50 substantially further than in the prior art. The receivers 62 for the bolt ends 116 are formed considerably deeper to accommodate this increased length of the bolt ends 116. As illustrated in FIG. 4, the receiver 62 extends for the full thickness of one of the wall studs 110, typically approximately two inches (about 5.1 centimeters). Since the receiver 62 according to the present invention may be formed so that it lies very close to the surface, or at the surface of the wall stud 110, and according to ordinary construction practice the only things that would lie on one side of the receiver 62 would be the wall board 112 and trim casing 114 which could easily be broken by ramming against the exterior surface 16 of the door 12, a metal reinforcing plate 120 forms one wall of the receiver 62. The metal reinforcing plate 120 is attached securely, as by long wood screws 122 to the wall stud 110. It will be immediately appreciated that the added length of the bolt 116 outer ends prevents unauthorized entry such as might be obtained in the prior art structures by jacking or springing the jamb 30. It will further be appreciated that the added length of the bolt outer ends 116, combined with the metal reinforcing plate 120, helps prevent such unauthorized entry as was previously available by ramming against the exterior side 16 of the door 12.

As best illustrated in FIG. 2, rather than a metal reinforcing plate 120, the entire receiver 62 can be lined with a cup-shaped liner 64 which may be secured to the wall stud 110 by long screws of the same type illustrated in FIG. 4.

Since the security door system 10 illustratively is to be a "deadbolt" type system, it may be desirable to bias the bolts 56 to their extended positions in the receivers 62. Referring again particularly to FIG. 2, this may be done by providing one or more springs 124 for urging the bolts 56 to their extended positions. In FIG. 2, the spring 124 is connected between one of arms 92 and an ear 126 provided on the interior wall of housing 72. Additional springs or stronger springs may be provided to achieve a desired spring return force.

In the further illustrative embodiments of FIGS. 5–9, those elements numbered identically with the various elements of FIGS. 1–4 perform the same or similar functions.

Figure 5:
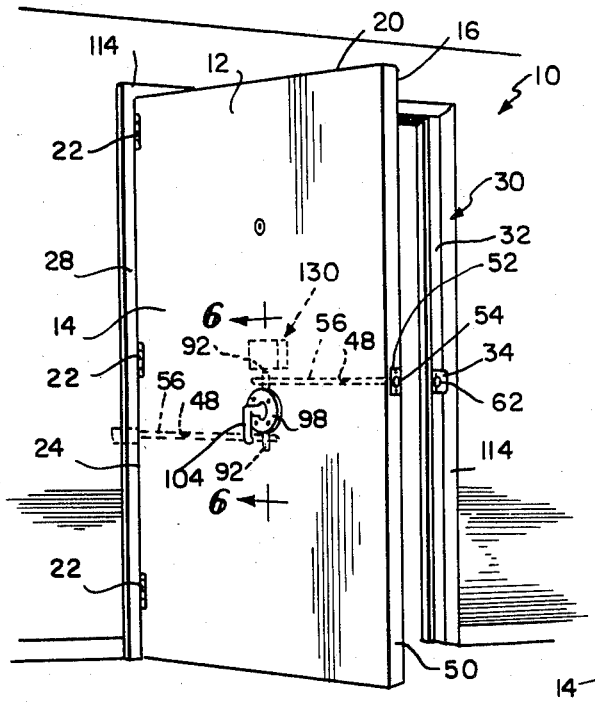
FIG. 5 is an elevational view of another door system constructed according to the present invention.
Figure 6:
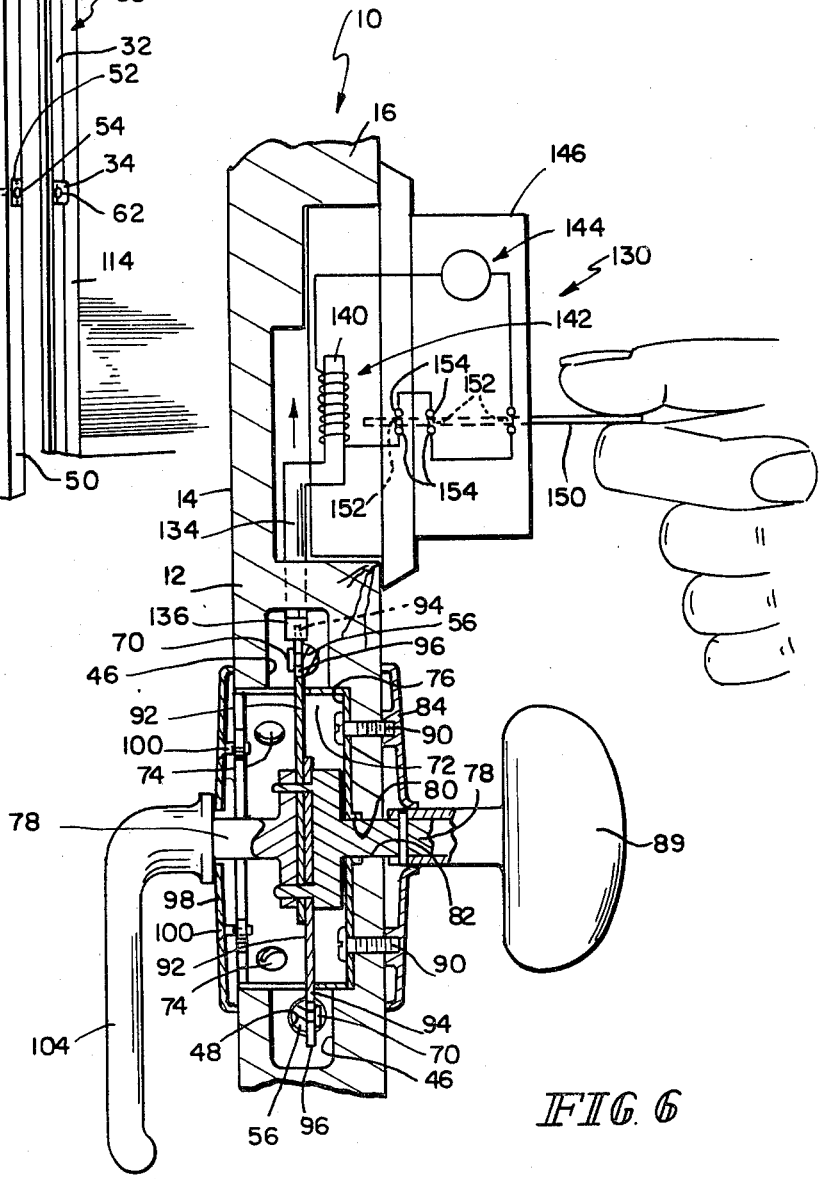
FIG. 6 is a fragmentary sectional view taken generally along section lines 6—6 of FIG. 5, showing diagrammatically certain components of the system, and a method for its operation.

In the embodiment illustrated in FIGS. 5–6, the separate key-actuable doorknob assembly and latch bolt 38, 36, respectively, are omitted. The actuator spindle 78 extends through a passageway 80 (FIG. 6) provided in wall 76, and through an aligned passageway 82 provided in door 12 to the exterior side 16 of door 12 where a knob 89 is fitted to the spindle 78 end which projects through to the exterior side 16 of door 12. A trim plate 84 is mounted on the door 12 side 16 surrounding the passageway through which spindle 78 end extends. The trim plate 84 is attached to the exterior side 16 of the door by screws 90 which extend through from wall 76. This minimizes the possibility of tampering with the actuator mechanism in housing 72 by removing the trim plate, since screws 90 are not exposed on exterior side 16. A locking system 130 for the security door system 10 is provided. The locking system 130 includes a vertically slidable bolt 134 which, when arms 92 are in their positions illustrated in solid lines in FIG. 2, has a vertically lower end 136 which fits into the slot 96 at the vertically upper end 94 of the upper arm 92. This prevents rotation of the actuator spindle 78. Bolt 134 is connected to a solenoid plunger 140 of a solenoid 142. A voltage source 144, illustrated diagrammatically, is provided within the locking system housing 46. Voltage source 144 may either be internal to the housing 146, or may be a pair of terminals across which a voltage is impressed through suitable conductors (not shown) from some point external to the door 12. The circuit between the voltage source 144 and solenoid 142 is completed when a key card 150 having properly code-spaced strips 152 is inserted into a space provided for insertion of the card in housing 146, contacting code-spaced circuit terminals 154. This energizes the solenoid 142 and raises the plunger 140 and bolt 134 to free actuator spindle 78 for rotation to permit entry through the door 12.

Figure 7:
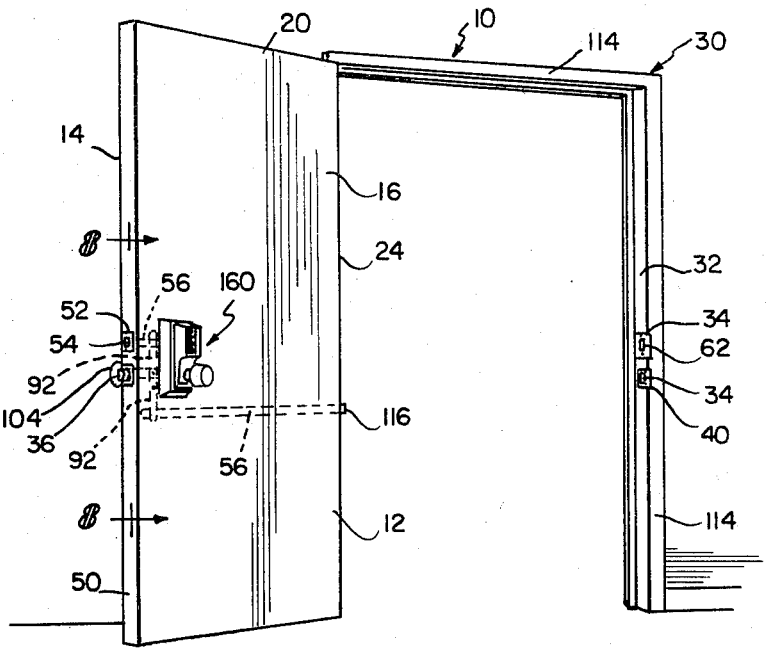
FIG. 7 is an elevational view of a door system constructed according to the present invention.
Figure 8:
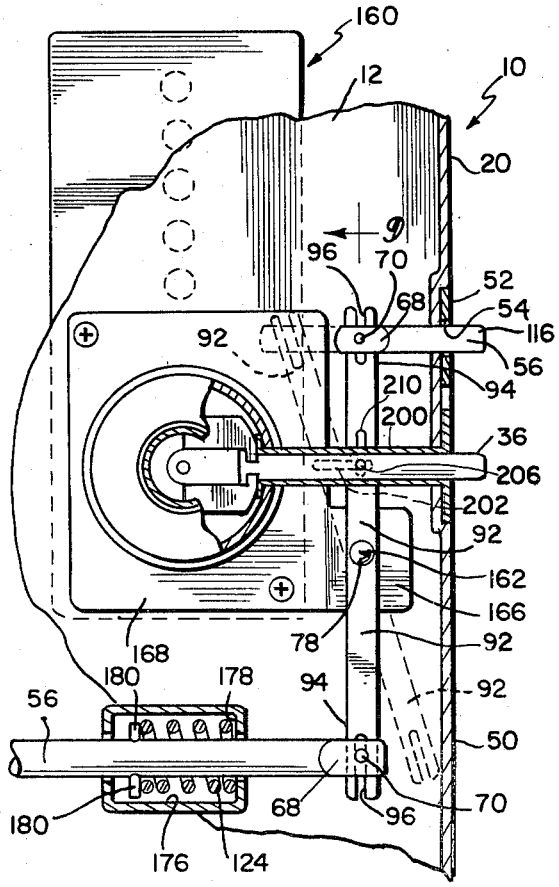
FIG. 8 is a fragmentary sectional view taken generally along section lines 8—8 of FIG. 7; and, FIG. 9 is a fragmentary sectional view taken generally along section lines 9—9 of FIG. 8.
Figure 9:
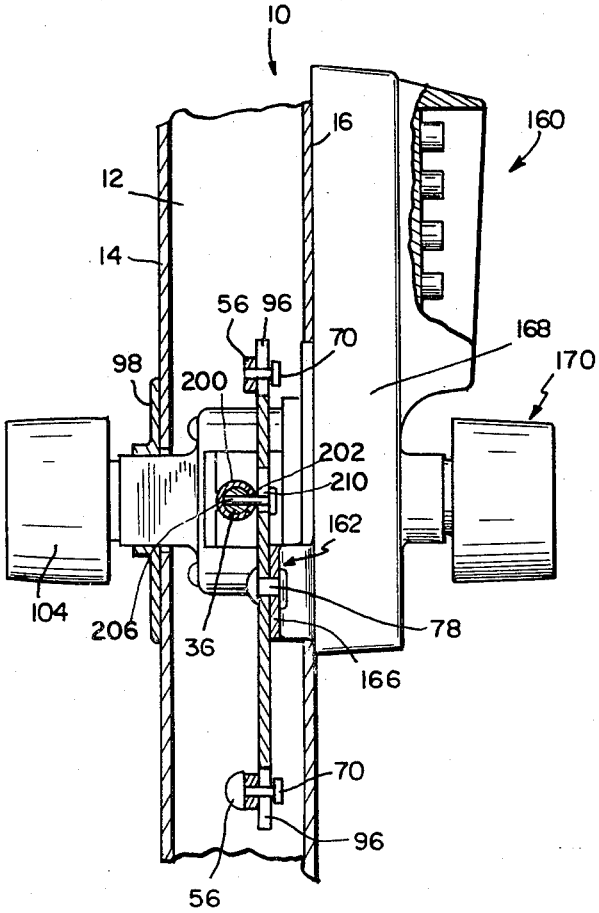

Turning now to the embodiment of the invention illustrated in FIGS. 7–9, the actuator mechanism is driven by means of a push button coded doorknob assembly 160. Assembly 160 is of a type such as the UNICAN 1000, available from Simplex Security Systems, Inc., 10 Front Street, Collinsville, Connecticut 06022.

The actuator spindle 78 in this embodiment includes a pin by which the latch bolt 36 of assembly 160 is pivotally attached to the actuator arms 92 at a distance from the pivot point 162 of the arms 92. The pivot point 162 includes a rivet attaching the arms 92 to a tongue 166 provided on the housing 168 of assembly 160. It will be appreciated that as the doorknob mechanism 170 withdraws the latch bolt 36 from its receiver 34 in the door jamb 30, (FIG. 7), the arms 92 pivot to their positions illustrated in broken lines in FIG. 8 retracting bolts 56 from their receivers 62 on both sides of the jamb 30.

Assembly 160 includes a spring (not shown) for restoring the latch bolt 36 to its projected position, illustrated in FIGS. 7–8, and for returning the doorknobs to their rest positions. In many circumstances, the restoring force provided by this spring may be sufficient to return arms 92 and bolts 56, 58 to their positions illustrated in solid lines in FIG. 8. In other situation, however, it may be desirable to provide a cavity 176 (see FIG. 8) in the door 12 which houses an auxiliary return spring 124. Spring 124 in this embodiment works against an end wall 178 of the cavity 176 and against pins 180 on one of bolts 56 to return bolts 56 and arms 92 as the latch bolt 36 returns to its projected orientation, illustrated in FIG. 8.

The sleeve 200 surrounding bolt 36 is provided with a longitudinally extending slot 202 through which extends a pin 206 mounted on bolt 36. The slot permits reciprocation of the pin 206 with the bolt. The pin 206 projects through a slot 210 provided in arm 92. This provides the necessary lost motion connection between bolt 36 and arm 92 to drive arm 92 and bolts 56 in response to bolt 36 movement.

What is claimed is:

1. A security door system comprising a door having an interior side and an exterior side, and a perimetrally extending door edge, a cavity provided in the door, the cavity opening into the interior side, a bolt actuator mechanism housing, the housing located in the cavity so as not to be accessible from the door exterior side, the bolt actuator mechanism including an actuator spindle and an arm mounted for movement about the spindle axis, the arm including a distal end, a passageway provided between the cavity and the door exterior side, the actuator spindle extending through the first passageway, a passageway provided between the cavity and the door edge for reciprocably housing a bolt, a lost motion connector for connecting the interior end of the bolt to the distal end of the arm, the lost motion connector including a slot in the distal end of the arm, means on the door jamb providing a receiver for the bolt exterior end, exterior and interior handles on the actuator spindle to permit movement of the bolt from the exterior and interior sides of the door, a lock mechanism for selectively inhibiting movement of the actuator mechanism, the lock mechanism including a second bolt for projection into the slot in the distal end of the arm to prevent movement of the arm about the spindle axis, the bolt actuator mechanism housing sized for insertion into the cavity, the actuator mechanism housing being box-like and sufficiently closed to prevent tampering with the actuator mechanism.

2. The apparatus of claim 1 including means for coupling the second bolt to a plunger associated with a solenoid, and means for coupling the solenoid in a circuit for energization through the cooperation of a code card.

3. The apparatus of claim 1 wherein the lock mechanism includes a push button combination code device requiring a plurality of buttons to be pushed in a proper sequence to actuate the lock mechanism to release the bolt actuator mechanism to permit retraction of the bolt.

4. The apparatus of claim 1 wherein the lost motion connector includes a pin on the bolt for engaging in the slot, and the slot extends generally longitudinally of the arm, rotation of the arm causing reciprocating movement of the bolt.

5. The apparatus of claim 4 and further comprising spring means for returning the bolt to a rest position projecting from the door edge, the spring means being attached to the arm and the actuator mechanism housing.

6. The apparatus of claim 4 and further comprising spring means for returning the bolt to the rest position, the spring means being housed in the door adjacent the second-mentioned passageway, the bolt including a stop against which the spring means bears, retraction of the bolt from the rest position causing the spring means to exert a force on the bolt to return it to the rest position.

7. The apparatus of claim 1 wherein the actuator mechanism comprises means providing a rack and means for connecting the rack to the bolt, and a pinion for engaging the rack, means for coupling the pinion for rotation about the axis of the actuator spindle, rotation of the pinion in one direction withdrawing the bolt from a rest position in which it projects from the door edge.

8. The apparatus of claim 1 wherein the bolt actuator mechanism further comprises a second arm mounted for movement about the spindle axis, the apparatus further including a second bolt and the door including a third passageway provided between the cavity and the door edge for reciprocably housing the second bolt, means on the door jamb providing a receiver for the second bolt exterior end, and a second lost motion connector for connecting the distal end of the second arm to the second bolt.

9. The apparatus of claim 8 wherein the second-mentioned and third passageways extend transversely and horizontally across the door in opposite directions, the door having a hinged edge portion, the second-mentioned passageway opening on the door edge opposite the hinged edge portion, and the third passageway opening on the hinged edge portion.

10. A security door system comprising a door having a perimetral edge from which a bolt selectively projects to hold the door in closed orientation, an interior side and an exterior side, a cavity provided in the door and opening into the interior side, a bolt-actuator mechanism housed within the cavity including an actuator spindle and an arm mounted for movement about the spindle axis, the arm including a distal end, a passageway provided between the cavity and the door exterior side, the actuator spindle extending through the first passageway, a passageway provided between the cavity and the door edge for reciprocably housing the bolt, a lost motion connector for connecting the interior end of the bolt to the distal end of the arm, the lost motion connector including a slot in the distal end of the arm, a jamb surrounding the door, the jamb including a receiver portion for the bolt, a frame surrounding and supporting the jamb, means providing wall surfaces surrounding the jamb, a hinge for supporting the door for movement in one direction to an open orientation and in the other direction to a closed orientation, exterior and interior handles on the actuator spindle to permit movement of the bolt from the exterior and interior sides of the door, a trim casing surrounding the jamb and covering the joint between the jamb and wall surface-providing means, a lock mechanism including a second bolt for projection into the slot in the distal end of the arm to prevent movement of the arm about the spindle axis, and means defining a receiver portion in the frame aligned with the receiver portion in the jamb, the means defining a receiver portion in the frame including a metal reinforcing portion secured to the frame to provide a wall of the receiver portion provided in the frame, the metal reinforcing portion being covered by the wall means and trim casing to minimize tampering with the bolt.

11. A security door system comprising a door having an interior side and an exterior side and a perimetrally extending door edge, a cavity provided in the door, a doorknob assembly mounted in the cavity, a reciprocable actuator mounted in the door, means operatively connecting the reciprocable actuator to the doorknob assembly, rotation of the doorknob moving the reciprocable actuator, an arm, means for pivotally mounting the arm in the cavity, means for connecting the arm to the reciprocable actuator such that reciprocation of the actuator causes pivotal movement of the arm, a bolt mounted for reciprocation in the door between a position projecting from the door edge and a position retracted into the door edge, and means connecting the bolt to the arm such that pivotal movement of the arm moves the bolt between its projected and retracted positions.

12. The apparatus of claim 11 wherein the reciprocable actuator is a latch bolt reciprocable by movement of the doorknob assembly between a position projecting from the door edge and a position in which it is retracted into the door edge.

13. The apparatus of claim 12 wherein the means connecting the first-mentioned bolt to the arm includes a lost motion connector.

14. The apparatus of claim 13 wherein the lost motion connector includes means providing a pin on the first-mentioned bolt and means providing a slot on the arm, the slot extending generally longitudinally of the arm and the pin extending into the slot.

15. The apparatus of claim 12 in which the door edge includes a bottom edge portion, a top edge portion, and two side edge portions, and the first-mentioned bolt and latch bolt project from the same side edge portion.

16. The apparatus of claim 12 in which the door edge includes a bottom edge portion, a top edge portion, and two side edge portions, and the first-mentioned bolt and latch bolt project from opposite side edge portions.

17. The apparatus of claim 16 and further comprising a third bolt mounted for reciprocation in the door between a position projecting from the door edge and a position retracted into the door edge, and means connecting the third bolt to the arm such that pivotal movement of the arm moves the third bolt between its projected and retracted positions.

* * * * *